US006216920B1

(12) United States Patent
Baggett

(10) Patent No.: US 6,216,920 B1
(45) Date of Patent: Apr. 17, 2001

(54) COMBINED SPRAY BOTTLE AND PAPER TOWEL HOLDER

(75) Inventor: David Baggett, N. Lauderdale, FL (US)

(73) Assignee: Atico International USA, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/455,573

(22) Filed: Dec. 6, 1999

Related U.S. Application Data

(60) Provisional application No. 60/115,098, filed on Jan. 7, 1999.

(51) Int. Cl.[7] ..... B67D 1/07

(52) U.S. Cl. ..... 222/192; 242/422.5; 222/383.1

(58) Field of Search ..... 222/192, 383.1; 242/597.7, 422.5

(56) References Cited

U.S. PATENT DOCUMENTS

| | | | | |
|---|---|---|---|---|
| D. 307,843 | | 5/1990 | Parshall . | |
| D. 363,214 | | 10/1995 | Parola . | |
| D. 406,976 | | 3/1999 | Baggett . | |
| 4,012,007 | * | 3/1977 | Cunningham | 242/55.54 |
| 4,436,224 | * | 3/1984 | McInerny | 222/183 |
| 4,792,102 | * | 12/1988 | Olson | 242/55.54 |
| 5,135,179 | * | 8/1992 | Morano | 242/55.42 |
| 5,671,872 | * | 9/1997 | Daniels, Jr. | 222/192 |
| 5,788,136 | * | 8/1998 | Othman | 225/79 |
| 5,799,895 | * | 9/1998 | Michaud et al. | 242/423 |
| 5,819,989 | * | 10/1998 | Saraceni | 222/192 |

* cited by examiner

*Primary Examiner*—Kevin Shaver
*Assistant Examiner*—F Nicolas

(74) *Attorney, Agent, or Firm*—Cobrin & Gittes

(57) ABSTRACT

A combination spray bottle and paper towel holder configured and arranged to prevent an edge of a roll of paper towels from being damaged by condensate and/or fraying, comprising a body having a shaft, a base, a hand grip, a flange, a threaded screw-top; a tensioner; and a spray assembly. The body serves as a reservoir for liquids. The roll of paper towels is inserted over the shaft, rests on the flange and does not contact the base. The tensioner maintains pressure on the roll of paper towels, preventing the uncontrolled unrolling thereof. The tensioner is attached to the spray bottle at two attachment locations, located on the body at locations beyond either edge of the roll of paper towels when the roll is inserted over the shaft. At least one of the attachment locations is such that the tensioner is releasably attached thereto. A combination spray bottle and paper towel holder configured and arranged to prevent an edge of a roll of paper towels from being damaged by fraying or otherwise, comprising a body having a shaft, a base, a threaded screw-top; a tensioner; and a spray assembly; where the tensioner is attached to the spray bottle at two attachment locations, located on the body at locations beyond either edge of the roll of paper towels when the roll is inserted over the shaft, at least one of which is a non-protruding hook that prevents the edge of the roll of paper towels farthest from the base from becoming damaged. A combination spray bottle and paper towel holder configured and arranged to prevent a roll of paper towels from unrolling in an uncontrolled manner, comprising a body having a shaft, a base, a threaded screw-top; a tensioner; and a spray assembly; where the tensioner includes an elastic band, the ends of which are bound by a clasp that prevents the elastic band from losing tension or otherwise separating at the ends.

11 Claims, 7 Drawing Sheets

COMBINED SPRAY BOTTLE AND PAPER TOWEL HOLDER

CROSS-REFERENCE TO RELATED PATENT APPLICATIONS

Provisional Application Serial No. 60/115,098, filed Jan. 7, 1999, currently pending.

STATEMENT REGARDING FEDERALLY SPONSORED RESEARCH OR DEVELOPMENT

Not Applicable.

BACKGROUND OF THE INVENTION

1. Field of the Invention

The present invention relates to a combined spray bottle and paper towel holder that is useful in all fields where liquid is to be sprayed and then wiped off with a paper towel.

2. Discussion of the Related Art

Combined spray bottles and paper towel holders are conventional. The advantages of combining a spray bottle and a paper towel include having two items as a single unit. Whenever the cleaning fluid is sprayed, paper towels are needed to mop up the liquid. An advantage of combining a spray bottle with a paper towel as a single unit is that one hand can be used to hold both the paper towels and the spray bottle, thus freeing the other hand to wipe up the spray with a towel removed or torn from the towel holder. Designs for a combined spray bottle and paper towel holder are exemplified by U.S. Pat. Nos. Des. 307,843 and 363,214. The present inventor has also received a design patent for such a device, U.S. Pat. No. Des. 406,976.

What is needed is a combined spray bottle and paper towel holder that permits a user to tear paper towels from a paper towel roll, is easy to assemble and repair, and prevents the paper towel roll from becoming frayed and/or wet before the towels are torn from the roll.

Accordingly, the present invention provides a novel combined spray bottle and paper towel holder including a tensioner that permits paper towels to be torn from the paper towel roll, as well as a flange, situated between the shaft and the base, which prevents the bottom edge of the paper towel roll from contacting the base when the combined device is fully assembled. The tensioner of the novel combined spray bottle and paper towel holder is releasably attached to the elongated shaft of the device, thereby providing for both easy assembly of the device and repair of the tensioner, when necessary.

BRIEF SUMMARY OF THE INVENTION

The combined spray bottle and paper towel holder of the present invention comprises a hollow body having an elongated shaft, a threaded screw-top, a grip, a base attached to an end of the elongated shaft, a flange and first and second attachment locations; and a tensioner.

Preferably, the elongated shaft is a tube whose outer diameter is smaller than the diameter of a cardboard support tube inside a roll of paper towels, and whose length exceeds that of the support tube of the type used on the inside of a roll of paper towels. The elongated shaft is able to be inserted into the support tube of a roll of paper towels. Further, the elongated shaft is able to act as a reservoir for the liquid to be sprayed.

A portion of the spray bottle between the elongated shaft and the end of the spray-bottle farthest from the base includes a grip to assist a user in holding the combined spray bottle and paper towel holder even when it includes a full reservoir of fluid and a complete roll of paper towels. The end of the spray bottle farthest from the base includes a threaded screw-top.

The diameter of the base is larger than that of the elongated shaft. Further, the base of the spray bottle is hollow and also acts as a reservoir. The support tube inside the roll of paper towels rests on an annular flange. The paper towel roll rotates relative to the flange as sheets of towel are pulled from the roll. The flange supports the paper towel roll and separates it from the base. The flange prevents the edge of the paper towel roll nearest the base from becoming frayed and/or wet as it rotates.

A tensioner is provided to keep the paper towels from unfolding from the roll. The tensioner also presses against the roll of paper towels and creates a shearing effect when a towel is torn from the roll.

An elastic band or strap applies pressure against the outer edge of the paper towel roll. The sheath encircling the strap may roll, allowing the paper towel roll to be pulled. When a sheet of towel is pulled hard, the paper towel tears along its perforation at a point between the tensioner and the free end of the paper towel.

DETAILED DESCRIPTION OF THE INVENTION

Figure 1:
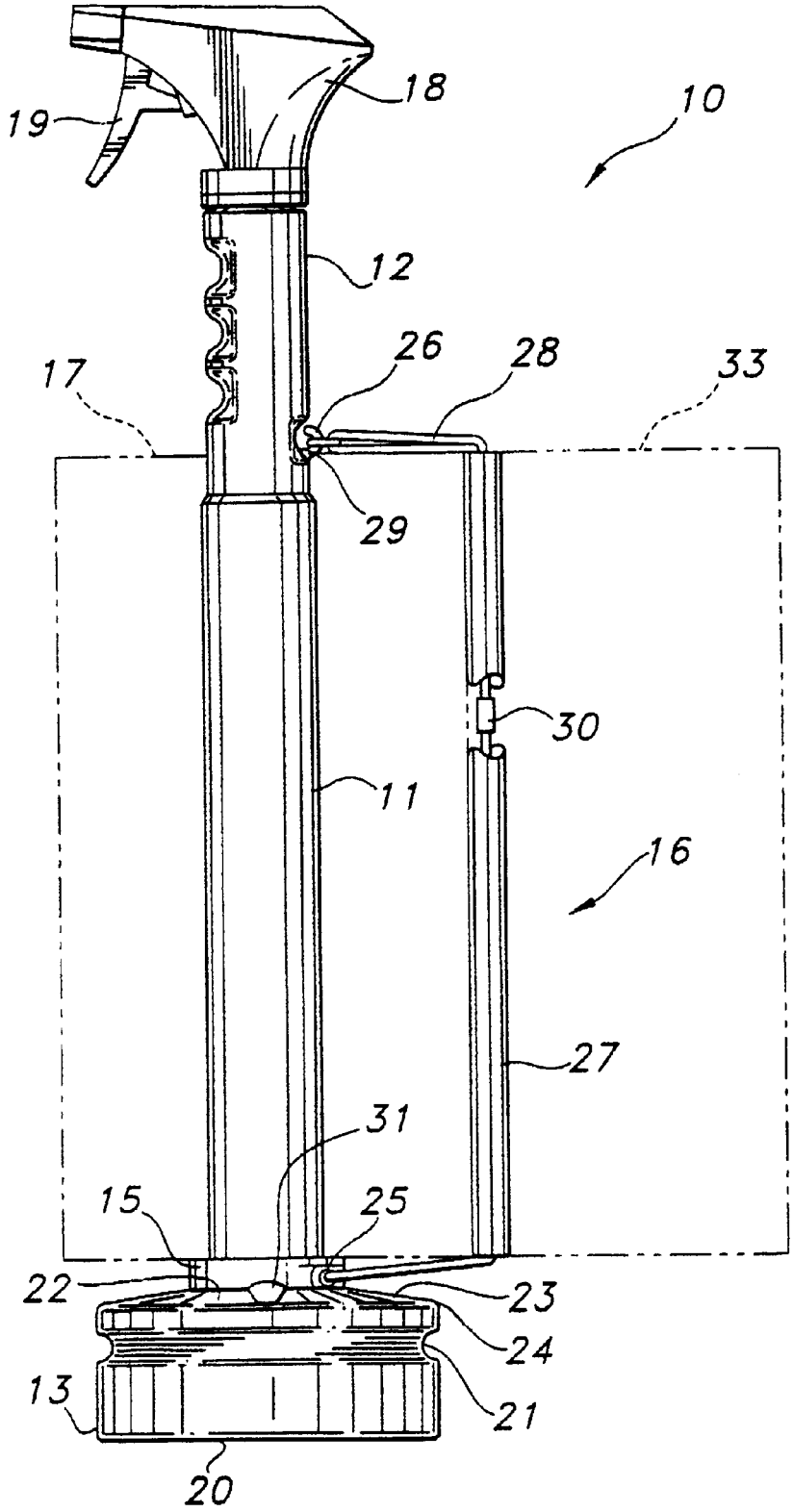
FIG. 1 is a side view of the first preferred embodiment of the combined spray bottle and paper towel holder of the present invention with a paper towel roll and sheet shove in phantom.
Figure 2:
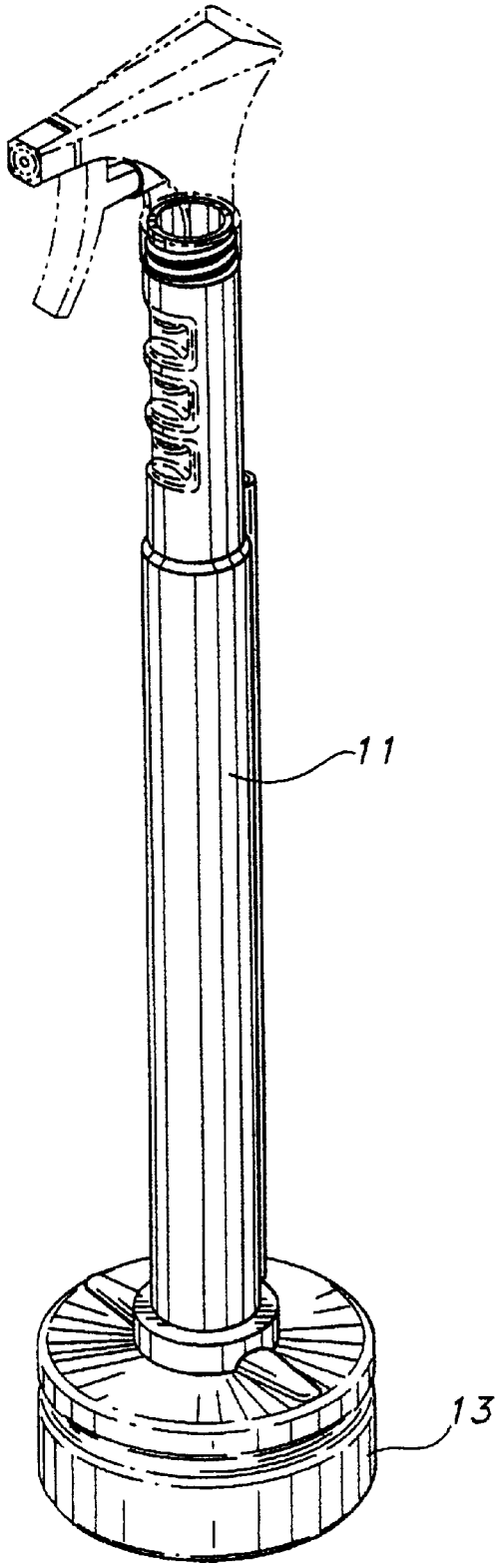
FIG. 2 is a perspective view of the first preferred embodiment of the combined spray bottle and paper towel holder of the present invention with the trigger assembly in phantom.
Figure 3:
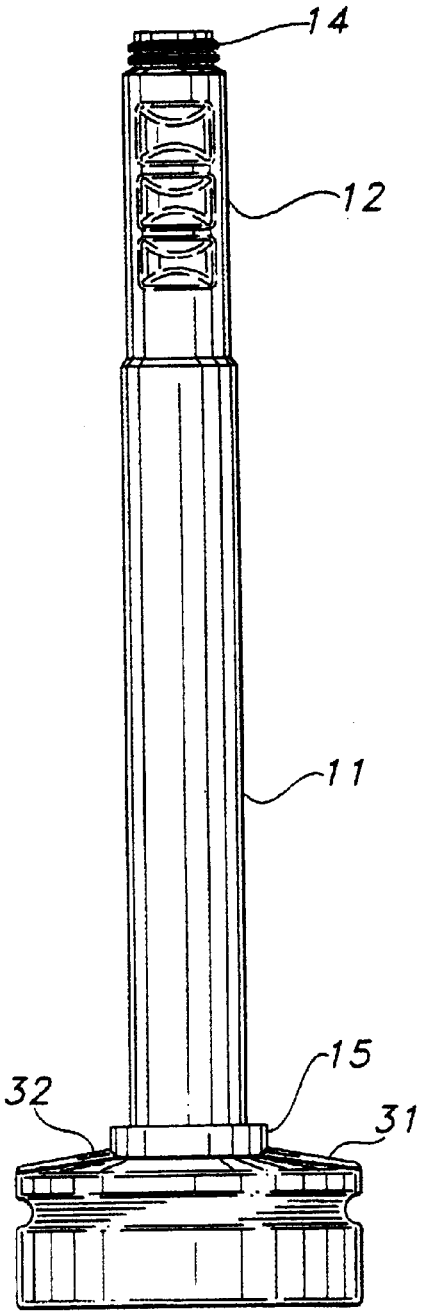
FIG. 3 is a grip-side view of the combined spray bottle and paper towel holder of the present invention.
Figure 4:
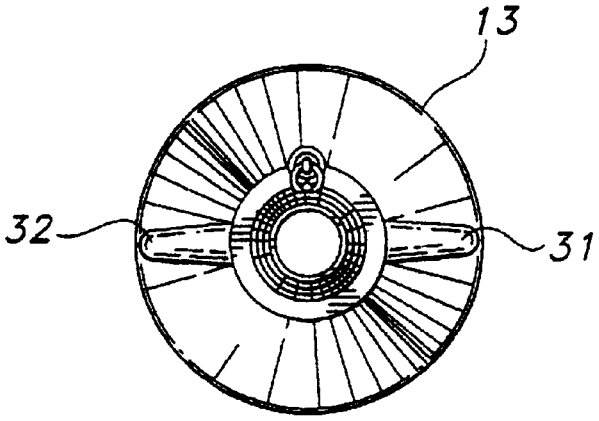
FIG. 4 is a top view of the combined spray bottle and paper towel holder of the present invention.
Figure 5:
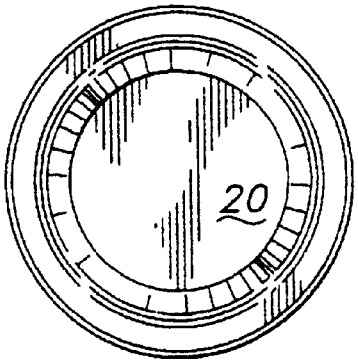
FIG. 5 is a bottom view of the combined spray bottle and paper towel holder of the present invention.
Figure 6:
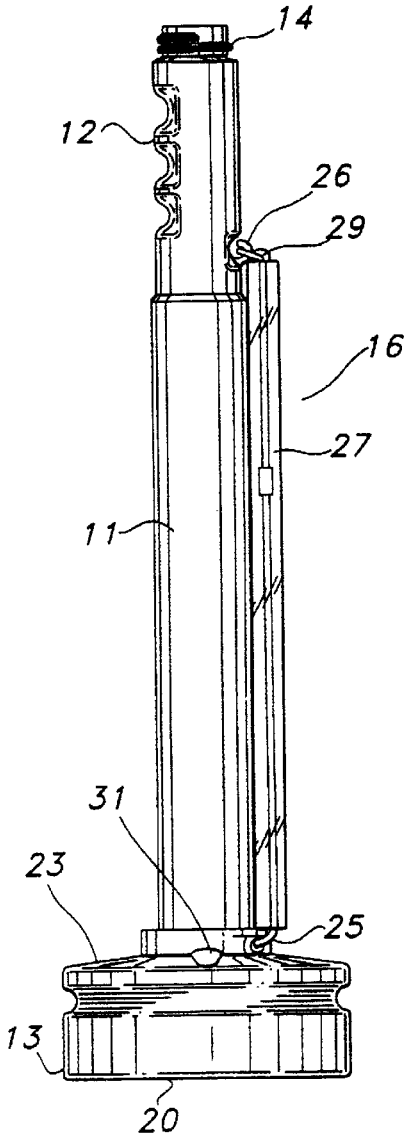
FIG. 6 is a side view of the first preferred embodiment of the combined spray bottle and paper towel holder of the present invention.
Figure 7:
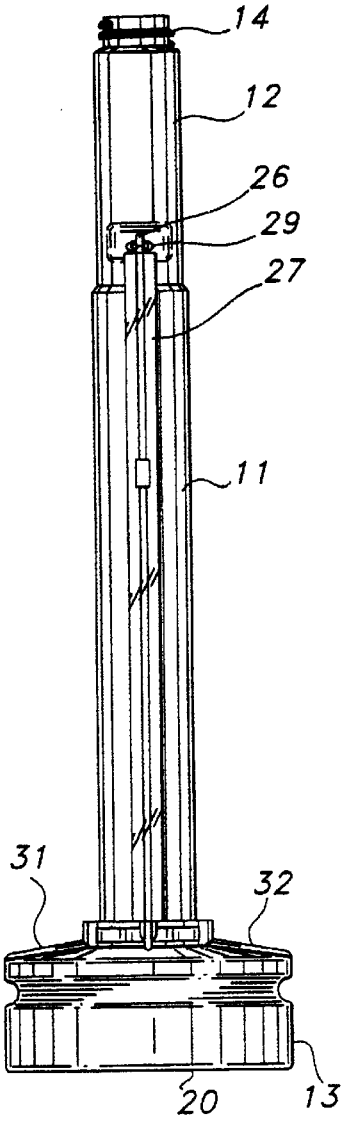
FIG. 7 is a tensioner-side view of the first preferred embodiment of the combined spray bottle and paper towel holder of the present invention.
Figure 8:
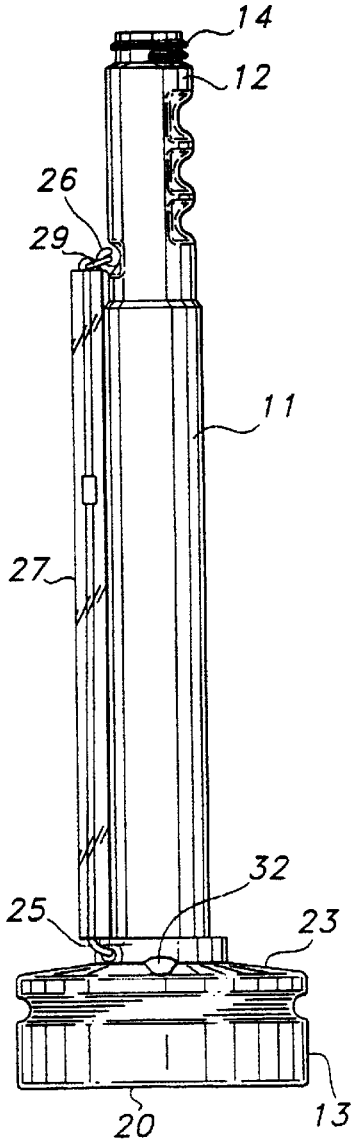
FIG. 8 is a side view of the first preferred embodiment of the combined spray bottle and paper towel holder of the present invention, viewed from the side opposite that in FIG. 6.
Figure 9:
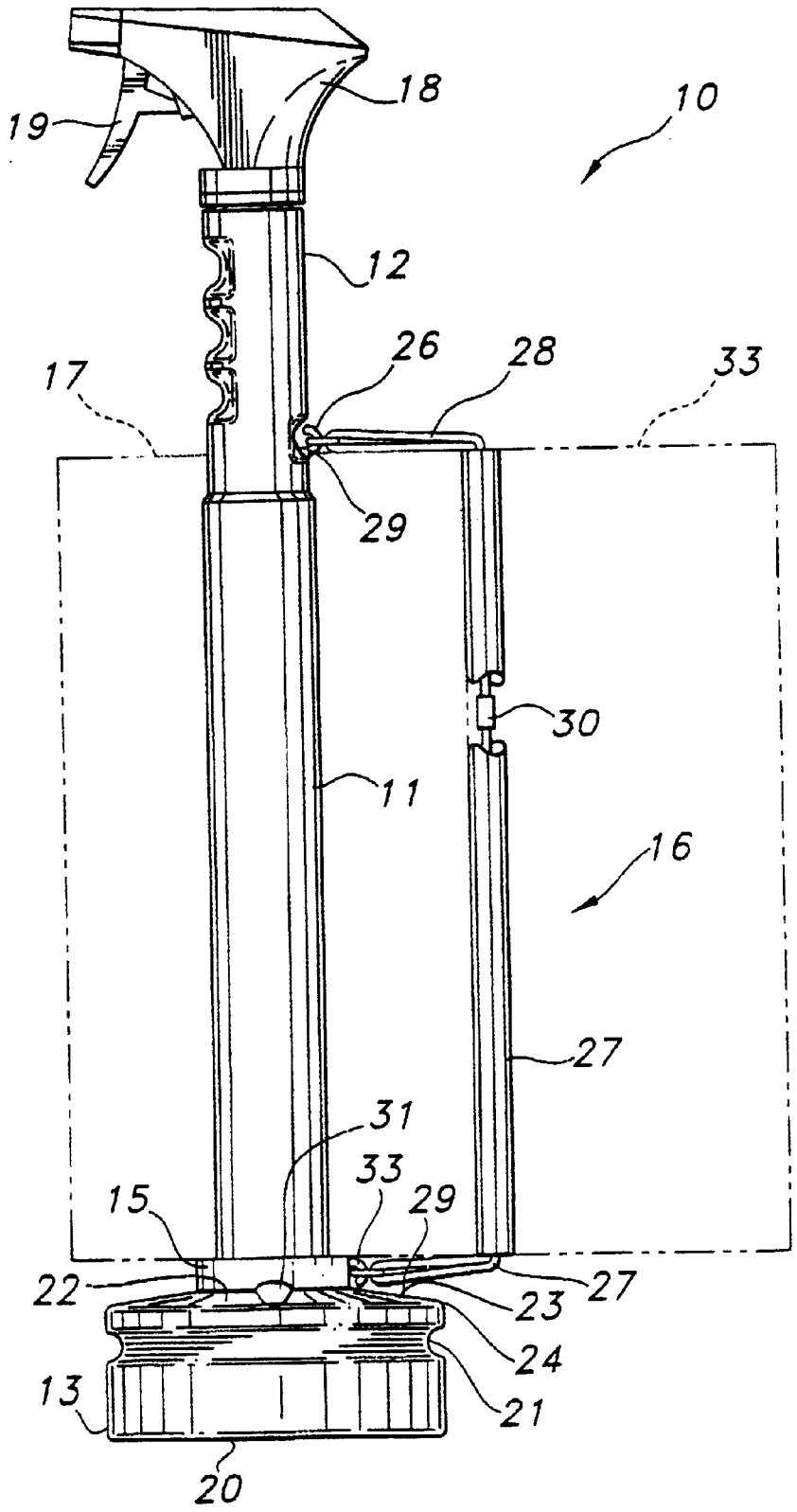
FIG. 9 is a is a side view of the second preferred embodiment of the combined spray bottle and paper towel holder of the present invention with a paper towel roll and sheet shown in phantom.

Turning to FIGS. 1, 3 and 9, first and second preferred embodiments of the combined spray bottle and paper towel holder 10 comprise a hollow body having an elongated shaft 11, a base portion 13 at one end of the body and connected to the elongated shaft 11, a threaded screw-top portion 14 at the end of the hollow body farthest from the base 13, and a hand grip portion 12 located on the body between the threaded screw-top portion 14 and an edge of a roll of paper towels 17 farthest from the base 13 after the roll 17 is inserted over the shaft 11. An annular flange 15 is located between the shaft 11 and the base 13, and a tensioner 16 runs parallel to the shaft 11 and is attached to spray bottle 10 at a location between the grip portion 12 and the edge of the roll of paper towels 17 farthest from the base 13, and also at a location between the edge of the roll of paper towels 17 nearest the base 13 and a bottom 20 of the base.

In both the first and second preferred embodiments, the tensioner 16 is releasably attached to the spray bottle 10 at a first attachment location, comprising a hook 26 and located on the spray bottle 10 at a location between shaft 11 and hand grip portion 12. Attachment is effected by placing ring 29, through which extends an elastic band 28, in contact with hook 26, such that ring 29 is held by hook 26. Hook 26 is configured to be non-protruding relative to the outside of the shaft 11, thereby preventing an edge of the roll of paper towels 17 farthest from the base 13 from becoming frayed or otherwise damaged.

Non-protruding hook 26 extends outwardly from a recess in elongated shaft 11 to a length so that a combined distance of the depth of said recess and a diameter of a portion of elongated shaft 11 situated at the same elevation as recess is at most the same as the outer diameter of elongated shaft 11. Non-protruding hook 26 located farthest from a vertical axis of shaft 11 is located at a distance from the vertical axis that is at most the same as the distance of the outer edge of shaft 11 from said vertical axis.

The elongated shaft 11 is a tube. The diameter of the shaft 11 is smaller than the inside diameter of a cardboard support tube inside a roll of paper towels 17. The elongated shaft 11 has a height/length greater than the height of a roll of paper towels 17 so that when shaft 11 is inserted through the cardboard support tube, shaft 11 extends beyond the edge of paper towel roll 17 farthest from base 13 when the roll 17 rests on flange 15.

Preferably, grip 12 has three indentations for the fingers. Preferably, the indentations are sized for adult fingers.

Located at the end of the hollow body of spray bottle 10 farthest from base 13, is a screw-top 14 that is threaded to receive a sprayer assembly 18 which screws onto threaded screw-top 14. The spray assembly 18 includes a trigger 19.

The diameter of flange 15 is greater than that of shaft 11, and also is greater than the inside diameter of a cardboard support tube inside a roll of paper towels 17. Paper towel roll 17 is placed over shaft 11 such that, in its assembled position, paper towel roll 17 rests on flange 15 and does not contact base 13.

Base 13 has a diameter that is larger than that of shaft 11, and has a generally flat bottom 20. Preferably, base 13 is cylindrical, and its cylindrical walls include a circular indentation 21 which strengthens the side walls of base 13. The top 23 of base 13 is slanted such that the center portion 22 of the top 23 of base 13 is higher than the outer circumferential edge 24. Base 13 also includes a pair of opposed support ridges 31 and 32 on the top 23 of base 13.

Turning to FIG. 1. in a first preferred embodiment spray bottle 10 also includes an eye 25 comprising a second attachment location for the tensioner 16. The second attachment location is located on spray bottle 10 at a location between the edge of the roll of paper towels 17 nearest the base 13 and the bottom 20 of the base.

In the first preferred embodiment, tensioner 16 is comprised of an elastic band 28, a clasp 30, a sheath 27, and a ring 29. Tensioner 16 provides tension on the paper towel roll 17 to prevent unwanted and/or uncontrolled unrolling of the paper towels and to facilitate tearing of a sheet from the paper towel roll 17. In this embodiment, tensioner 16 attaches non-releasably to the second attachment location of spray bottle 10 via eye 25. An end of elastic band 28 runs through eye 25, inside of sheath 27, and through a ring 29. The ends of elastic band 28 are then either tied or are bound with a clasp 30, with the tied or bound ends of elastic band 28 thereafter located within sheath 27 for aesthetic purposes. Ring 29 is larger in diameter than sheath 27 so that ring 29 does not pull through sheath 27 under the tension of the elastic band 28. Ring 29 releasably attaches to spray bottle 10 at the first attachment location, via hook 26, such that a used paper towel roll can be removed and a new one inserted.

Turning to FIG. 9, in a second preferred embodiment the second attachment location comprises a second hook 33, rather than an eye 25. In this embodiment, tensioner 16 includes a second ring 29. In this embodiment, elastic band 28 runs through second ring 29, inside of sheath 27, and through first ring 29. The ends of elastic band 28 are then either tied or are bound with a clasp 30, with the tied or bound ends of elastic band 28 thereafter located within sheath 27 for aesthetic purposes. The clasp prevents the elastic band 28, when bound via the clasp from losing tension, and also prevents the ends of the elastic band 28 from otherwise becoming separated. The clasp provides the additional advantage that a damaged elastic band can be replaced with relative ease.

When assembled, tensioner 16 exhibits a length of band 28 supporting a ring 29 protruding from either end of sheath 27. In this embodiment, tensioner 16 is releasably attached to spray bottle 10 at both the first and second attachment locations, via hooks 26 and 33 respectively.

In both a first and second preferred embodiment, sheath 27 is a tube. The length of sheath 27 is approximately the same as that of paper towel roll 17. Sheath 27 is preferably cylindrical in shape. Elastic band 28 is lengthed to exert sufficient pressure or tension on the paper towel roll 17 to permit the tearing of individual rolls therefrom.

In both embodiments of FIGS. 1 and 9, shaft 11 and base 13 are connected to form a contiguous volume for containing liquids. Also, the hollow body of the combined spray bottle and paper towel holder 10 of the present invention, including shaft 11, hand grip portion 12, base portion 13, and threaded screw-top 14 is formed as a single piece of plastic. The flange 15, eye 25 (or hook 33), hook 26 and support ridges 31 and 32 also are part of this single piece of plastic.

The hollow body of the combined spray bottle and paper towel holder of the present invention, along with flange 15, eye 25 (or hook 33), hook 26 and support ridges 31 and 32 may be formed from conventional materials, including but not limited to plastics, according to conventional methods. Likewise, the sheath 27 and ring(s) 29 may be formed from conventional materials, according to conventional methods. Elastic band 28 may be any elastic band of sufficient length and tension.

Spray assembly 18 may be any conventional threaded spray assembly which is designed for dispensing liquids, either in a mist or spray, such as a squirt pump head. Spray assembly 18 includes, in addition to trigger 19, a further tube inserted into the tube of shaft 11, and through which the liquid to be dispensed is drawn from shaft 11 and/or base 13 to spray assembly 18.

Figure 10:
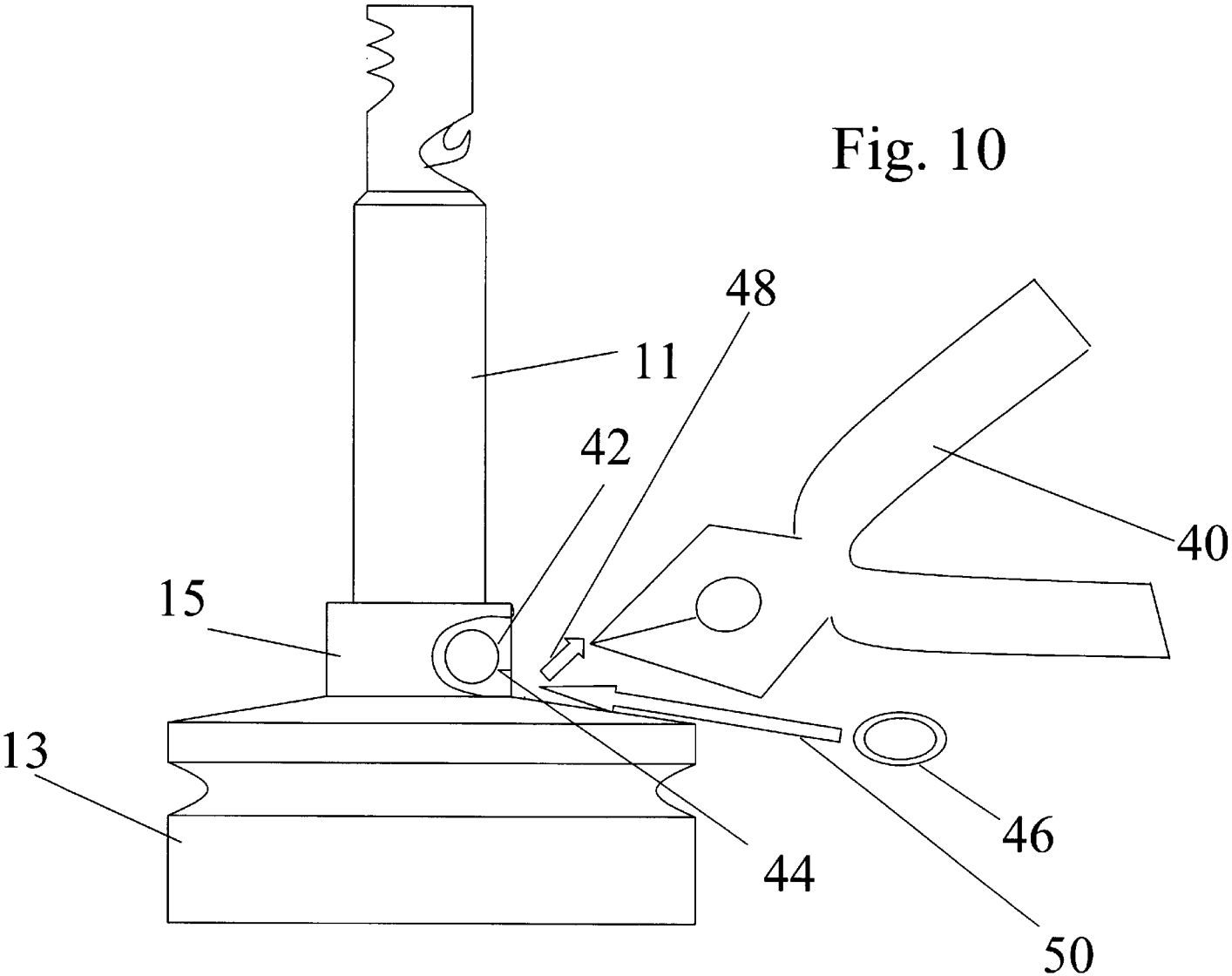
FIG. 10 is a schematic representation of using heated pliers to heat a metal ring to melt plastic to form opposing hooks.
Figure 11:
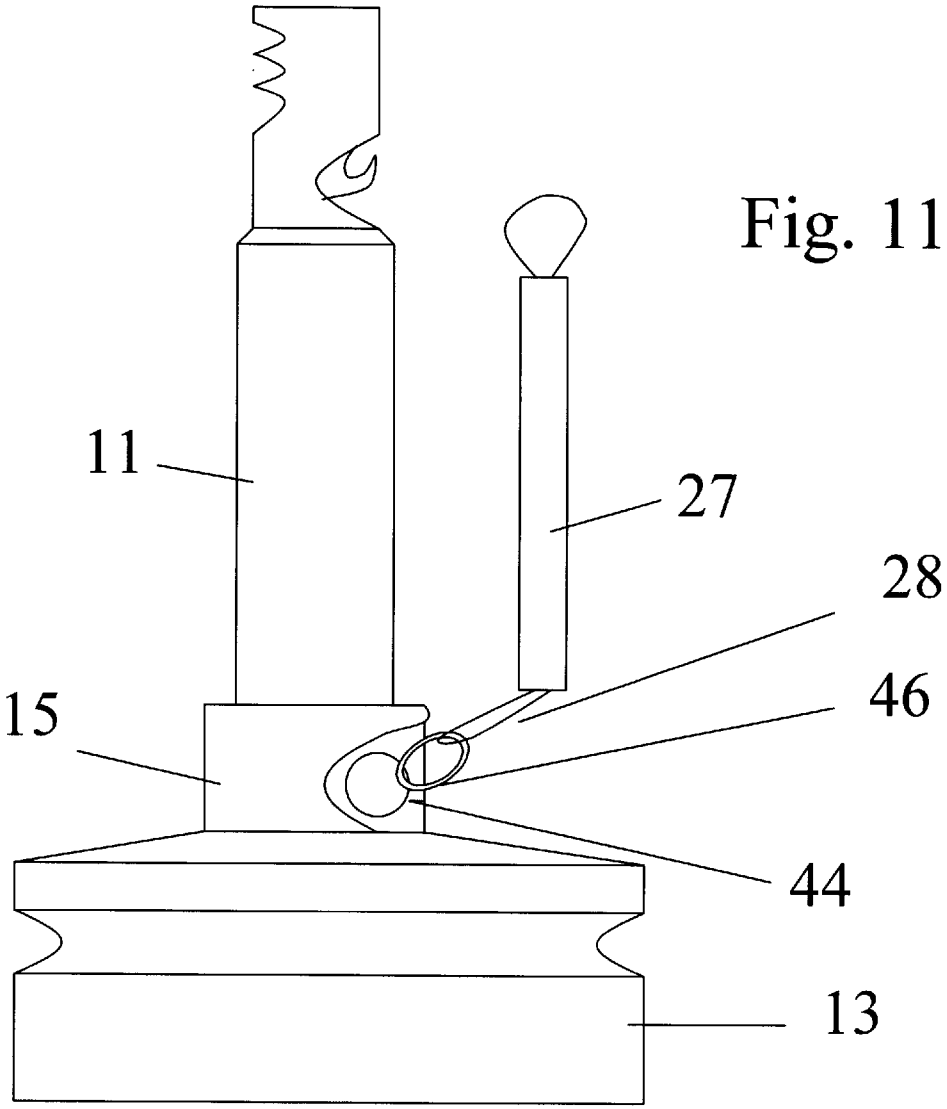
FIG. 11 is a schematic representation of using heated pliers to heat the opposing plastic hooks to close the opening between them so as to form a closed loop around the metal ring.

Turning to FIGS. 10 and 11, conventional heated pliers 40 are used to heat an eye wall 42 of the eye 25 (FIG. 1) of the flange 15 to form a hairline sever 44. The opposed faces of the eye wall 42 at sever 44 touch each other. The conventional heated pliers 40 are exemplified by those used by South Florida Plastics of Opa-loca, Fla. in the manufacture of the present invention.

Once the sever 44 is formed, the pliers 40 are pulled away from the sever in the direction of the smaller arrow 48 in FIG. 10. A metal ring 46 is then moved in the direction of the larger arrow 50 in FIG. 10 and inserted through the gap 44. This metal ring 46 is preferably a double looped ring of the type commonly found on key chains.

Turning to FIG. 11, one or more elastic bands 28 extend through the sheath 27 so that a respective opposite end of the elastic band(s) protrude(s) out of an associated open end of the sheath 27. If two bands are used, for instance, a clasp 30 secures them to each other within the sheath. The clasp 30 (FIG. 9) may have an S shape so as to constitute two oppositely facing hooks each grasping one of the elastic bands 28.

An end of the elastic band 28 that protrudes out of the sheath 27 is then easily slipped through the double loop of the metal ring 46 to secure itself under tension to the metal ring 46. Likewise, the other protruding end of the elastic band(s) 28 is secured to an identical metal ring, which in turn is secured to the hook fastener that is above the shaft 11.

The metal ring 46 is passed through the hairline sever 44 to fit within the eye as shown in FIG. 11. Once in position, it will not slip out inadvertently through the hairline sever 44 because the opposing faces of the eye wall 42 resiliently return to a position of touching each other after the ring has passed through. Preferably, the metal ring 46 is arranged to project in a manner that does not interfere with the placement of the roll of paper towels 17 about the shaft 11. If desired, the hook fastener may be replaced by a severed eye structure identical to that in flange 15 that has the eye wall 42 and sever 44.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A combined spray bottle and paper towel holder configured and arranged to prevent an edge of a roll of paper towels from being damaged by condensate and/or fraying, comprising:

a hollow body configured and arranged to contain liquids, said body comprising:

an elongated shaft comprising a tube whose outer diameter is smaller than the diameter of a cardboard support tube inside a roll of paper towels, and whose length exceeds that of the support tube;

a hollow base located at an end of said body and connected to said elongated shaft so that said base and said elongated shaft form a single contiguous volume, said base having a diameter that is larger than that of said elongated shaft;

a screw-top threaded to receive a squirt pump head thereon and located at a height on said body such that it is at an end of said body farthest from said base;

a hand grip located at a height on said body such that it is between said threaded screw-top portion and an edge of said roll of paper towels farthest from said base after said roll of paper towels is inserted over said elongated shaft, and comprising notches in said body;

a flange configured and arranged to prevent an edge of said roll of paper towels that is nearest said base after said roll of paper towels has been inserted over said elongated shaft from contacting said base and becoming damaged by condensate and/or fraying, said flange being located on said body between said elongated shaft and said base and situated so that said roll of paper towels, when placed over said elongated shaft, rests on said flange and does not contact said base;

a hook at a first attachment location on said body that is at a location between said hand grip and said edge of said roll of paper towels farthest from said base;

an eye at a second attachment location on said body that is at a location between said edge of said roll of paper towels nearest said base and a bottom of said base;

a tensioner configured and arranged to prevent said roll of paper towels from unrolling in an uncontrolled manner and also to press against said roll of paper towels to allow said roll of paper towels to be rotated and to create a shearing effect when a towel is torn from said roll, said tensioner comprising:

an elastic band configured and arranged to prevent said roll of paper towels from unrolling in an uncontrolled manner and to create a shearing effect as a towel is torn from said roll, said band being tensioned by said eye at said second attachment location, thereby being non-releasably attached to said body at said second attachment location;

a sheath tube whose length is at less than the distance between said first and second attachment locations, said elastic band having ends within said sheath tube;

a ring through which said elastic band extends, said ring having a diameter that is greater than the diameter of said sheath tube, and said ring releasably being attached to said first attachment location via a hook;

a binder of the ends of said elastic band, the binder being within said sheath tube; and a spray assembly attached to said screw top.

2. The combined spray bottle and paper towel holder of claim 1, where said elastic band extends through said eye.

3. The combined spray bottle and paper towel holder of claim 1, further comprising a further ring extending through said eye, said elastic band being connected to said further ring in a manner that tensions said elastic band.

4. The combined spray bottle and paper towel holder of claim 1, wherein said binder is a clasp.

5. The combined spray bottle and paper towel holder of claim 1, wherein said spray assembly includes a trigger and a further tube extending into said elongated shaft and through which liquid may be drawn, said further tube of said spray assembly having a diameter that is less than an inside diameter of said elongated shaft.

6. A combined spray bottle and paper towel holder configured and arranged to prevent an edge of a roll of paper towels from being damaged by condensate and/or fraying, comprising:

a hollow body configured and arranged to contain liquids, said body comprising:

an elongated shaft comprising a tube whose outer diameter is smaller than the diameter of a cardboard support tube inside a roll of paper towels, and whose length exceeds that of the support tube;

a hollow base located at an end of said body and connected to said elongated shaft so that said base and said elongated shaft form a single contiguous volume, said base having a diameter that is larger than that of said elongated shaft;

a screw-top threaded to receive a squirt pump head thereon and located at a height on said body such that it is at an end of said body farthest from said base;

a hand grip located at a height on said body such that it is between said screw-top portion and an edge of said roll of paper towels farthest from said base after said roll of paper towels is inserted over said elongated shaft, and comprising notches in said body;

a flange configured and arranged to prevent an edge of said roll of paper towels that is nearest said base after said roll of paper towels has been inserted over said elongated shaft from contacting said base and becoming damaged by condensate and/or fraying, said flange being located on said body between said elongated shaft and said base and situated so that said roll of paper towels, when placed over said elongated shaft, rests on said flange and does not contact said base;

a first hook at a first attachment location on said body that is at a location between said hand grip and said edge of said roll of paper towels farthest from said base;

a second hook at a second attachment location on said body that is at a location between said edge of said roll of paper towels nearest said base and a bottom of said base;

a tensioner configured and arranged to prevent said roll of paper towels from unrolling in an uncontrolled manner and also to press against said roll of paper towels to allow said roll of paper towels to be rotated and to create a shearing effect when a towel is torn from said roll, said tensioner comprising:

a ring releasably attaching to said second attachment location via said second hook;

an elastic band configured and arranged to prevent said roll of paper towels from unrolling in an uncontrolled manner and to create a shearing effect as a towel is torn from said roll, said band extending through said ring;

a sheath tube having a diameter less than that of said ring, and whose length is less than the distance between said first and second attachment locations, said elastic band having ends within said sheath tube;

a further ring through which said elastic band extends, said further ring releasably being attached to said first attachment location via said first hook;

a binder of the ends of said elastic band, the binder being within said sheath tube; and a spray assembly attached to said screw top.

7. The combined spray bottle and paper towel holder of claim 6, wherein said binder is a clasp.

8. The combined spray bottle and paper towel holder of claim 7, wherein said spray assembly includes a trigger and a further tube extending into said elongated shaft and through which liquid may be drawn, said further tube of said spray assembly having a diameter that is less than an inside diameter of said shaft.

9. A combined spray bottle and paper towel holder configured and arranged to prevent an edge of a roll of paper towels from being damaged by fraying or otherwise, comprising:

a hollow body configured and arranged to contain liquids, said body comprising:

a shaft comprising a tube whose outer diameter is smaller than the diameter of a cardboard support tube inside a roll of paper towels, and whose length exceeds that of the support tube;

a hollow base located at an end of said body and connected to said elongated shaft so that said base and said elongated shaft form a single contiguous volume, said base having a diameter that is larger than that of said elongated shaft;

a screw-top threaded to receive a squirt pump head thereon and located at a height on said body such that it is at an end of said body farthest from the base;

a non-protruding hook at a first attachment location on said body that is at a location on said shaft such that said first attachment location is between said screw-top and an edge of said roll of paper towels that is farthest from said base when said roll is inserted on said elongated shaft, said non-protruding hook extending outwardly from a recess in said elongated shaft by a length so that a combined distance of a depth of said recess and a diameter of a portion of said elongated shaft situated at the same elevation as said recess is at most the same as the outer diameter of said shaft, said non-protruding hook that is located farthest from a vertical axis of said shaft being located at a distance from said vertical axis that is at most the same as the distance of an outer edge of said shaft from said vertical axis;

a fastener at a second attachment location on said body that is at a location between said edge of said roll of paper towels nearest said base and a bottom of said base;

a tensioner configured and arranged to prevent said roll of paper towels from unrolling in an uncontrolled manner and also to press against said roll of paper towels to allow said roll of paper towels to be rotated and to create a shearing effect when a towel is torn from said roll, said tensioner comprising an elastic band configured and arranged to prevent said roll of paper towels from unrolling in an uncontrolled manner and to create a shearing effect as a towel is torn from said roll, said elastic band being attached to said second attachment location via said fastener and being releasably attached to said first attachment location via said non-protruding hook;

a sheath tube whose length is less than the distance between said first and second attachment locations, said elastic band having ends within said sheath tube;

a binder of the ends of said elastic band, the binder being within said sheath tube; and a spray assembly attached to said screw top.

10. The combined spray bottle and paper towel holder of claim 9, where said fastener is a further non-protruding hook configured and arranged to prevent an edge of said roll of paper towels nearest said base from being frayed or otherwise damaged.

11. A combined spray bottle and paper towel holder configured and arranged to prevent a roll of paper towels from unrolling in an uncontrolled manner, comprising:

a hollow body configured and arranged to contain liquids, said body comprising:

a shaft comprising a tube whose outer diameter is smaller than the diameter of a cardboard support tube inside a roll of paper towels; and whose length exceeds that of the support tube;

a hollow base located at an end of said body and connected to said elongated shaft so that said base and said elongated shaft form a single contiguous volume, said base having a diameter that is larger than that of said elongated shaft;

a screw-top threaded to receive a squirt pump head thereon and located at a height on said body such that it is at an end of said body farthest from the base;

a hook located at a first attachment location on said body that is at a location between said hand grip and said edge of said roll of paper towels farthest from said base;

a fastener located at a second attachment location on said body that is at a location between said edge of said roll of paper towels nearest said base and a bottom of said base;

a tensioner configured and arranged to prevent said roll of paper towels from unrolling in an uncontrolled manner and also to press against said roll of paper towels to allow said roll of paper towels to be rotated and to create a shearing effect when a towel is torn from said roll, said tensioner comprising:

an elastic band, said elastic band being attached to said second attachment location via said fastener and being releasably attached to said first attachment location via said hook, said band being configured and arranged to prevent said roll of paper towels from unrolling in an uncontrolled manner and to create a shearing effect as a towel is torn from said roll;

a sheath tube whose length is less than the distance between said first and second attachment locations, said elastic band having ends within said sheath tube;

a clasp of the ends of said elastic band, said clasp being within said sheath tube and configured and arranged to bind together said ends of said elastic band and to prevent said elastic band from losing tension or otherwise separating at said ends; and a spray assembly attached to said screw top.

* * * * *